US008393412B2

(12) United States Patent
Camwell et al.

(10) Patent No.: US 8,393,412 B2
(45) Date of Patent: Mar. 12, 2013

(54) SYSTEM AND METHOD FOR ACCURATE WELLBORE PLACEMENT

(75) Inventors: Paul L. Camwell, Calgary (CA); John G. McRory, Calgary (CA); David D. Whalen, Calgary (CA); James M. Neff, Okotoks (CA)

(73) Assignee: Xact Downhole Telemetry, Inc., Calgary, Alberta (CA)

( * ) Notice: Subject to any disclaimer, the term of this patent is extended or adjusted under 35 U.S.C. 154(b) by 287 days.

(21) Appl. No.: 12/704,368

(22) Filed: Feb. 11, 2010

(65) Prior Publication Data

US 2010/0200296 A1 Aug. 12, 2010

Related U.S. Application Data

(60) Provisional application No. 61/152,003, filed on Feb. 12, 2009.

(51) Int. Cl.
*E21B 47/022* (2012.01)

(52) U.S. Cl. ..... 175/45; 367/81; 367/127

(58) Field of Classification Search ..... 175/45, 175/61, 62; 367/127, 81
See application file for complete search history.

(56) References Cited

U.S. PATENT DOCUMENTS

| | | | | |
|---|---|---|---|---|
| 3,268,859 | A * | 8/1966 | Watts | 367/36 |
| 3,529,682 | A * | 9/1970 | Coyne et al. | 175/45 |
| 3,828,867 | A * | 8/1974 | Elwood | 175/45 |
| 3,876,016 | A * | 4/1975 | Stinson | 175/45 |
| 3,979,724 | A * | 9/1976 | Silverman et al. | 367/36 |
| 4,021,773 | A | 5/1977 | Keenan | |
| 4,984,289 | A * | 1/1991 | Arakawa et al. | 405/184 |
| 5,070,462 | A * | 12/1991 | Chau | 701/300 |
| 5,128,901 | A | 7/1992 | Drumheller | |
| 5,160,925 | A | 11/1992 | Dailey et al. | |
| 5,477,505 | A | 12/1995 | Drumheller | |
| 5,720,354 | A * | 2/1998 | Stump et al. | 175/26 |
| 6,161,630 | A * | 12/2000 | Stump et al. | 175/26 |
| 6,177,882 | B1 | 1/2001 | Ringgenberg et al. | |
| 6,250,402 | B1 * | 6/2001 | Brune et al. | 175/45 |
| 6,320,820 | B1 | 11/2001 | Gardner et al. | |
| 6,435,286 | B1 * | 8/2002 | Stump et al. | 175/26 |
| 6,791,474 | B2 | 9/2004 | Lenz et al. | |
| 6,920,943 | B2 * | 7/2005 | Mercer et al. | 175/26 |
| 6,956,791 | B2 * | 10/2005 | Dopf et al. | 367/82 |
| 6,968,909 | B2 | 11/2005 | Aldred et al. | |
| 7,228,900 | B2 | 6/2007 | Schultz et al. | |
| 7,663,373 | B1 * | 2/2010 | Gard et al. | 324/346 |
| 2002/0031050 | A1 * | 3/2002 | Blevins et al. | 367/127 |

(Continued)

FOREIGN PATENT DOCUMENTS

WO WO-2009146548 12/2009

OTHER PUBLICATIONS

Schlumberger Oilfield Glossary entry for "bottomhole assembly" accessed Feb. 22, 2012 via www.glossary.oilfield.slb.com.*

(Continued)

*Primary Examiner* — Daniel P Stephenson
*Assistant Examiner* — Blake Michener
(74) *Attorney, Agent, or Firm* — Law Office of Mark Brown, LLC; Mark E. Brown

(57) ABSTRACT

A system and method of closed loop control whereby groupings of surface sonic transmitters disposed along the planned path of a well send sonic wave energy to a downhole sonic receiver (or alternatively a downhole sonic transmitter signalling to grouping of surface sonic receivers) in a manner that facilitates the downhole positioning of the well. Subsequent offset well positioning, relative to the first well, may be achieved in a similar manner.

27 Claims, 16 Drawing Sheets

U.S. PATENT DOCUMENTS

| | | | | |
|---|---|---|---|---|
| 2003/0006071 | A1* | 1/2003 | Stump et al. | 175/61 |
| 2003/0076106 | A1* | 4/2003 | Mercer | 324/326 |
| 2006/0131014 | A1* | 6/2006 | Huang et al. | 166/250.07 |
| 2007/0039776 | A1* | 2/2007 | Clark | 181/110 |
| 2007/0153629 | A1* | 7/2007 | Drumheller et al. | 367/162 |
| 2007/0257809 | A1* | 11/2007 | Camwell et al. | 340/853.7 |
| 2011/0100712 | A1* | 5/2011 | Poedjono | 175/45 |

OTHER PUBLICATIONS

Drumheller, Douglas S., "Acoustical Properties of Drill Strings", *J. Acoust. Soc. Am.*, (Mar. 1989), 85(3).

Young, Warren C., et al., "Roark's Formulas for Stress and Strain", *Case 1, 7th Edition, McGraw-Hill*, (Sep. 13, 2001),p. 592, Section 13.8 Tables, Table 13.1.

Lapeyrouse, Norton J., "Formulas and Calculations for Drilling, Production, and Workover", 2nd edition, 2002, *Gulf Professional Publishing, an imprint of Elsevier Science*, (2002),p. 6.

Grover, Wayne D., et al., "Development and Performance Assessment of a Distributed Asynchoronous Protocol for Real-Time Network Restoration", *IEEE Journal on Selected Areas in Communications*, (Jan. 1991),9(1): 112-125.

Besaisow, A. A., et al., "Development of a Surface Drillstring Vibration Measurement System", *60th Annual Technical Conference and Exhibition of the Society of Petroleum Engineers*, Las Vegas, NV, (Sep. 22, 1985), pp. 1-14.

Besaisow, A. A., et al., "Application of ADAMS (Advanced Drillstring Analysis and Measurement System) and Improved Drilling Performance", *IADC/SPE Drilling COnference*, Houston, TX, (Feb. 27, 1990), pp. 717-722.

Barnes, et al., "Passband for Acoustic Transmisssion . . . Drill String", *Journal Acout. Soc.of Amer.*, vol. 51, #5, (1972),pp. 1606-1608.

Squire, et al., "A new Approach to Drill-String Acoustic Telemetry", *SPE of AIME, SPE 8340*, (Sep. 1979).

Drumheller, Douglas S., "Wave Impedances of Drill Strings and Other Periodic Media", *J. Acoustical Society of America*, vol. 112, issue 6, (2002), 2527-2539.

Drumheller, Douglas S., "Wave Impedances of Drill Stings and Other Periodic Media", *The Journal of the Acoustical Society of America*, vol. 112, No. 6, (Dec. 2002),pp. 2527-2539.

"International Search Report and Written Opinion for PCT/US2011/032532", (Jun. 30, 2011).

* cited by examiner

FIG. 16A
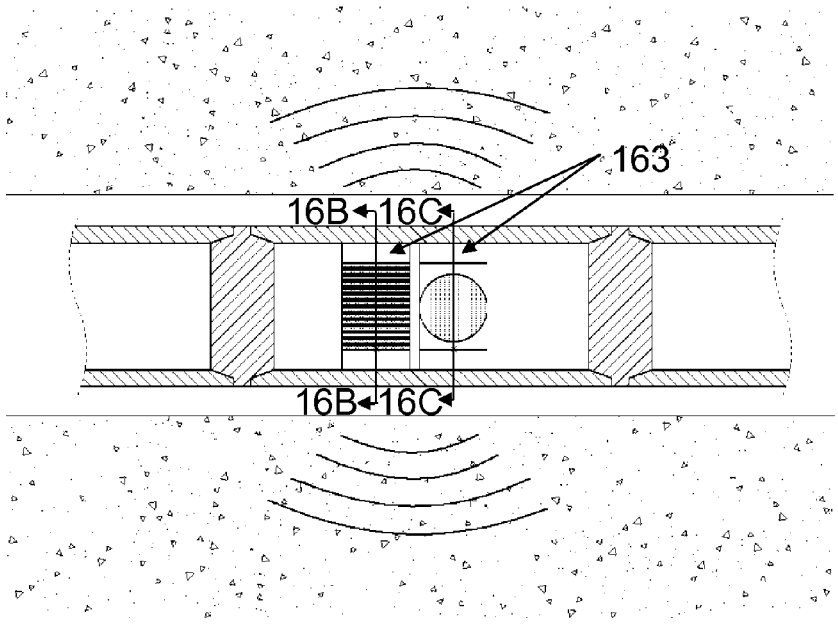
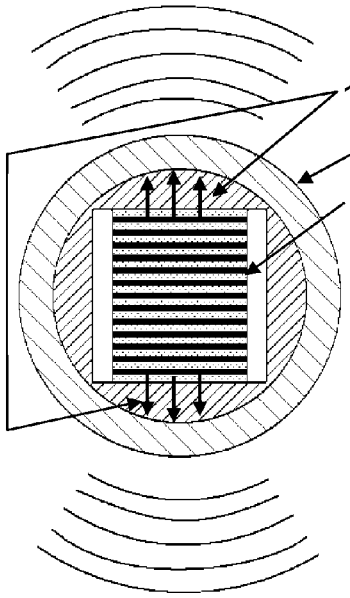
FIG. 16B
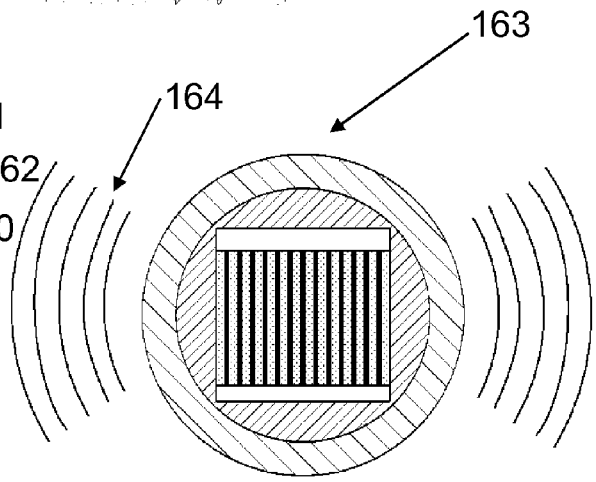
FIG. 16C

SYSTEM AND METHOD FOR ACCURATE WELLBORE PLACEMENT

CROSS REFERENCE TO RELATED APPLICATIONS

This application claims priority in U.S. Provisional Patent Application No. 61/152,003, filed Feb. 12, 2009, which is incorporated herein by reference.

BACKGROUND OF THE INVENTION

1. Field of the Invention

The present invention relates to telemetry equipment and methods, and particularly to sonic telemetry apparatus and methods used in the oil and gas industry associated with oil and gas exploration drilling, and in particular with the placement of the borehole in the earth in relatively precise alignment with a reference well or other reference locations.

2. Description of the Related Art

Ranging is the description of a general method whereby a specific measurement technique is used to determine the position of a borehole being drilled relative to a reference such as a surface reference or references or another borehole or set of boreholes. The position of the borehole being ranged specifically relates to the orientation, spacing or separation along all or part of the borehole relative to the reference.

In some drilling circumstances it may be important to determine the relative position of one or more boreholes in order to attain a certain separation and orientation (e.g. river crossing or steam-assisted gravity drainage (SAGD) well pair) or to either seek (e.g. relief well) or avoid (e.g. anti-collision) intersection between boreholes.

Avoiding intersection between boreholes that have been drilled when drilling a new borehole may be required on platforms or in areas that are congested with many previously drilled boreholes.

Achieving intersection between a borehole that has been drilled when drilling a new borehole may be required when a drilling a relief borehole or when linking a new borehole with an existing borehole.

Determining the relative position of a borehole relative to a surface reference in order to attain a certain separation and orientation is important when drilling underground passages such as those for cables or pipelines. These passages may be required to go under mountains, cities, roads, railroads or rivers or similar obstructions.

Determining the relative positions of two or more boreholes in order to attain a certain separation and orientation is important when a steam assisted gravity drainage production technique (SAGD) or similar techniques are used. The SAGD production technique for heavy oil, for example, involves the drilling of an upper and lower borehole pair with boreholes oriented in the same vertical plane and parallel to each other along the entire length of their horizontal sections. Steam that is injected into the upper borehole reduces the viscosity of the heavy hydrocarbons that are contained in the formations surrounding the upper borehole, thereby enabling these hydrocarbons to flow toward the lower borehole as a result of gravity. These hydrocarbons are then produced from the lower borehole using conventional production techniques. In order for the SAGD production technique to be successful, precise directional control must be maintained during the drilling of the borehole pair. Both the orientation and the distance between the boreholes must be precisely achieved. Typical separation distances between upper and lower boreholes are 15 m, with vertical and lateral relative displacements being held preferentially to within 1 m. This relatively precise directional control can be achieved using ranging techniques.

At present the ranging associated with SAGD wells is accomplished with certain magnetic techniques. The various shortcomings of commercial magnetic ranging techniques are discussed below.

The most recent, but so far commercially unproven, magnetic ranging technique requires that the casing in the target well be magnetised at various locations along the wellbore. A magnetic receiver system is installed in the well being ranged and ranging data are transmitted to surface using conventional MWD telemetry.

Existing commercial magnetic ranging techniques typically require the use of a wireline logging system to be deployed in the target well which can either be the injection or producing well. A tractor system is also required to convey the wireline magnetic receiver tool along the horizontal section of this wellbore. Alternatively, a coiled tubing system or a conventional jointed pipe rig can be used to convey the wireline magnetic receiver tool along the high angle sections of wellbore. In all cases the receiver tool must advance along the target wellbore in unison with the progress of the magnetic source in the well being drilled. Depth control must be achieved in both wells. Typical stated accuracy using magnetic ranging is about 100 cm. The present systems for drilling SAGD wells are particularly complex and would benefit in terms of reliability and cost with a simpler system.

The costs associated with the use of existing commercial magnetic ranging techniques include:

magnetic source tool
magnetic receiver tool
wireline telemetry system
wireline tractor for deploying wireline receiver tool or—
coiled tubing system for deploying wireline receiver tool or—
rig for deploying wireline receiver tool
surface ranging processing system The use of such equipment typically costs the producer several million dollars per well, thus showing that cost reduction would be a distinct benefit. Our invention uses a sonic ranging technique that is simpler and less expensive than magnetic ranging techniques, albeit with lesser ranging accuracy. We describe some of its benefits below. Our sonic ranging technique provides a simpler ranging solution in comparison to existing magnetic ranging systems due to the replacement of a tractor, rig or coil tube drilling (CTD) deployed wireline magnetic receiver with a surface deployed sonic transmitter. The sonic receiver is deployed in the bottom hole assembly (BHA) of the well being ranged and ranging data is either sent uphole via a measurement while drilling (MWD) system (also required for measurement of toolface orientation) or processed by a closed loop rotary steering tool (RST) system downhole.

Pertinent ranging techniques can be readily understood by reference to "Understanding GPS: Principles and Applications", Artech House, 1996, edited by E. D. Kaplan, section 2.1.

The costs associated with the use of the sonic ranging technique include surface source(s) and a sonic downhole receiver and either a surface ranging processing system for ranging data sent uphole via MWD telemetry and a downhole "short hop" or "direct wire" interface between the sonic receiver and the MWD system (if not already in place with standard equipment), or a downhole RST and downhole "short hop" or "direct wire" interface between the sonic receiver and the RST system (if not already in place with standard equipment), thereby leading to a dramatic reduction in equipment cost.

Furthermore the use of a sonic ranging system and a RST allows full closed loop control to be executed downhole without the need for surface processing or control using a directional driller. The accuracy and precision of the sonic ranging system is approximately an order of magnitude less than the magnetic ranging system (which may be accurate to 100 cm). However, this level of accuracy and precision is still acceptable for useable placement of wells such as SAGD well pairs or similar at a significantly lower cost because wellbore placement accurate to ~1 m is adequate in most instances. Indeed, this accuracy is also acceptable for the placement of single generally horizontal wells such as river crossing or road crossing etc. wells.

SUMMARY OF THE INVENTION

It is an object of the present invention to overcome the problems associated with the present state of the art in drilling boreholes that must follow an accurate trajectory as defined by the position from the surface, as presently implemented by a magnetic ranging device. It is a further object of the invention to overcome problems associated with enabling a second borehole to follow an accurate trajectory as defined by the first, again as defined by the position from the surface, and also as presently implemented by a magnetic ranging device.

In order to clarify the method and means we present to outline of some of the invention's applications and then go on to describe the specific means by which the invention can be implemented.

According to one aspect of the invention, a set of sonic transmitters deployed at the surface substantially above and along the intended path of first well of a borehole is used to provide a ranging means to a sonic receiver disposed in the bottom hole assembly of drilling equipment, the receiver being preferentially placed close to the drill bit. The sonic energy received from the surface is processed and ranging data is subsequently sent back to the drilling rig by conventional methods where it is decoded and further processed in order to provide the driller a profile of the wellbore being drilled. In one embodiment this profile is in effect replicated and then modified to provide information on the offset profile to be ideally taken for a second borehole to be drilled, the application being a second well of use in SAGD applications or similar. In this embodiment drilling the second well proceeds by the process as briefly described above being repeated with the received telemetry data being compared to the idealized profile using a processor or other devices capable of making comparisons of received data. Discrepancies between the ideal and the actual profile are used by the directional driller in order to correct the second borehole well and steer it substantially along the intended path.

In one aspect of the invention the sonic transmitters are deployed in regular repeating patterns, such as contiguous squares or rectangles, with their positions being accurately known via means such as surveying or deduced by the global positioning system. The individual transmitters in each square or similar configuration are firmly anchored using such means as rig anchors or screw piles into the consolidated formation below, thus enabling sonic energy to be produced locally in the well's environment. Each grouping of sonic transmitters is individually or severally activated to produce a modulated energy carrier such that the downhole receiver is able to deduce the relative time of flight existing between each transmitter. In one embodiment this information is telemetered back to the surface where it is processed with the additional location information of the appropriate transmitters, thus forming a set of simultaneous equations that can be solved to produce the most likely three-dimensional position of the receiver. This calculation is not unlike that by which simple global positioning system (GPS) location finding is achieved. In our case we initially assume the sonic time of flight is governed not only by distance but a generally isotropic speed of sound within the formation between surface and the subsurface borehole. Typical speeds range from 2500 to 3000 msec. To carry the analogy further, our sets of spaced sonic transmitters are equivalent to the constellation of GPS satellites, and the sonic receiver is equivalent to a passive GPS receiver.

To a first approximation the sonic transmitters act like point energy sources transmitting isotropically into the ground. This assumption is modified in yet another aspect of the invention by incorporating into each transmitter a beam-steering capability in order to efficiently send as much sonic energy as possible to the estimated location of the downhole receiver. As drilling proceeds the transmitters are included in a near real time closed loop system that keeps their sonic beams actively pacing the downhole drill receiver, thus enhancing the receiver's signal to noise ratio (SNR).

In a another embodiment whereby the second borehole is substantially steered by an RST or similar, the RST is equipped with appropriate sensing, decoding and processing device, such as a processor, to detect the sonic transmissions from the surface. This capability is particularly useful in that the RST can be configured to drill the second borehole offset from the first and thus has the information necessary to provide automatic course corrections without the need for a directional driller to implement course changes that would otherwise be required.

In yet another embodiment the surface sonic transmitters are replaced by surface sonic receivers (such as geophones arranged in a grid pattern) and with the downhole sonic receiver being replaced by a sonic transmitter deployed in the BHA, preferably in a manner that transfers sonic energy to the drill bit and hence into the formation. Alternatively the sonic transmitter may also transfer sonic energy into the formation by means such as the axial stabilizers that are often used to steer an RST.

BRIEF DESCRIPTION OF THE DRAWINGS

The following drawings illustrate the principles of the present invention and an exemplary embodiment thereof:

FIG. 16A shows an embodiment that implements a conventional stacked disc PZT sandwich transducer oriented in such a way that the axial force generated that sends sonic energy directly onto the tool casing.

FIG. 16B is a cross sectional view of the embodiment shown in FIG. 16A taken along the cut line.

FIG. 16C is a cross sectional view of the embodiment shown in FIG. 16A taken along the cut line.

DETAILED DESCRIPTION OF PREFERRED EMBODIMENTS

Figure 1:
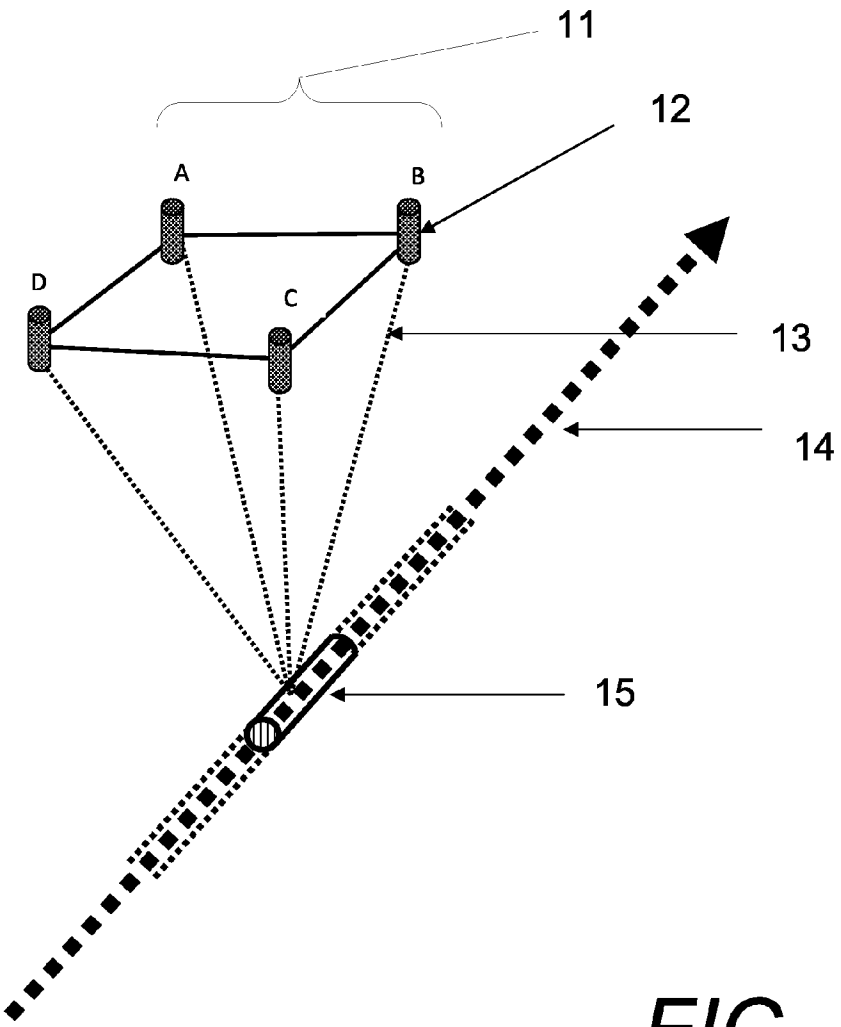
FIG. 1 shows a very simplified view of four surface transmitters emanating sonic waves into the subsurface formations toward a receiver located in the drill string.

The present embodiment(s) seeks to overcome non-optimal design constraints in the complexity and cost of magnetic ranging techniques in use today that are used to place single or pairs of boreholes. Our sonic ranging invention utilizes time of flight (TOF) ranging techniques that are presently unknown in the drilling industry.

It is well understood that the time of arrival (TOA) of a signal traveling from a source at a known location to a receiver can be used to calculate time of flight and hence the distance traveled by the signal through a known medium. When more than one source is used, an estimate of the location of the receiver can be made based on the TOF for each of the sources and the geometry of the sources, in effect utilizing a differential TOF (DTOF). Although the practical implementation of DTOF will be obvious to one skilled in the art we provide here a simplified analysis that uses a more commonly understood term—time differential of arrival (TDOA) as it pertains to multilateration, or a ranging technique that depends on the detection of several signals in order to ascertain position. For ease of understanding and clarity we use an example that is commonly used in civil and military surveillance applications to accurately locate aircraft, vehicles or stationary emitters by measuring the time difference of arrival of a signal from an emitter at three or more receiver sites, although it is to be understood that in our embodiments we use the reciprocal case.

Consider a single emitter and two receivers; if a sonic wave is emitted from a surface position it will arrive at slightly different times at two spatially separated subsurface receiver sites, the TDOA being due to the different distances of each receiver from the emitter. For a given location of each of the two receivers a multiplicity of emitter locations would give the same measurement of TDOA. Given two receiver locations and a known TDOA the locus of possible emitter locations is a one half of a two-sheeted hyperboloid i.e. a three-dimensional hyperbola. Note that the receivers do not need require the absolute time at which the wave was transmitted to solve the location equations—only the time difference is needed.

Consider now a third receiver at a third subsurface location. This would provide a second TDOA measurement and hence locate the emitter on a second hyperboloid. The intersection of these two hyperboloids describes a curve on which the emitter is expected to lie. If a fourth receiver is introduced a third TDOA measurement is available and the intersection of the resulting third hyperboloid with the curve already found with the other three receivers defines a unique point in space. The emitter's location is therefore fully determined in three dimensions.

Errors in the measurement of the time of arrival of pulses mean that enhanced accuracy can be obtained with more than four receivers. In general N receivers provide N−1 hyperboloids. Assuming a perfect model and measurements with N>4 receivers the N−1 hyperboloids would intersect at a single point. In reality the surfaces rarely intersect because of errors due to the non-homogeneity of the formation through which the waves travel. Furthermore the stratification of typical formations and differing transit paths that are utilized by the sonic waves can lead to variations in TDOA measurements, thereby increasing positional error. Of course there are many causes of error that would have to be accounted for arriving at a position estimation, as would be known to one reasonably skilled in the art. In our environment the location solution could be thought of as an optimization problem and solved using a least squares method, an extended Kalman filter technique or in addition the TDOA of multiple transmitted pulses from the emitter may be averaged to improve accuracy, to name but three examples.

The basic equations of our multilateration example are as follows: let the emitter be placed at an unknown location (x,y,z) that we wish to locate. Consider also a multilateration system comprising four receiver sites (L, R, Q, C) at known locations. The travel time ($T_L$) of pulses from the emitter at (x,y,z) to each of the receiver locations at ($x_L$,$y_L$,$z_L$) for example, is simply the distance divided by the speed of sound within the formation c (meters/second):

$$T_L = \frac{1}{c}\left(\sqrt{(x-x_L)^2+(y-y_L)^2+(z-z_L)^2}\right)$$

$$T_R = \frac{1}{c}\left(\sqrt{(x-x_R)^2+(y-y_R)^2+(z-z_R)^2}\right)$$

$$T_Q = \frac{1}{c}\left(\sqrt{(x-x_Q)^2+(y-y_Q)^2+(z-z_Q)^2}\right)$$

$$T_C = \frac{1}{c}\left(\sqrt{(x-x_C)^2+(y-y_C)^2+(z-z_C)^2}\right)$$

If the site C is taken to be at the coordinate system origin, we have $$T_C = \frac{1}{c}\left(\sqrt{x^2+y^2+z^2}\right)$$

The time difference of arrival between pulses arriving directly at site C, for example, and the other sites are:

$$\tau_L = T_L - T_C = \frac{1}{c}\left(\sqrt{(x-x_L)^2+(y-y_L)^2+(z-z_L)^2} - \sqrt{x^2+y^2+z^2}\right)$$

$$\tau_R = T_R - T_C = \frac{1}{c}\left(\sqrt{(x-x_R)^2+(y-y_R)^2+(z-z_R)^2} - \sqrt{x^2+y^2+z^2}\right)$$

$$\tau_Q = T_Q - T_C = \frac{1}{c}\left(\sqrt{(x-x_Q)^2+(y-y_Q)^2+(z-z_Q)^2} - \sqrt{x^2+y^2+z^2}\right)$$

where $(x_L, y_L, z_L)$ is the location of receiver site L, etc. Each equation defines a separate hyperboloid. The multilateration system solves for the unknown target location (x,y,z), all the other parameters being known.

Multilateration can also be used by a single receiver to help locate itself by measuring the TDOA of signals emitted from three or more synchronized transmitters at known locations (the 'reciprocal case').

Now moving on to a more specific horizontal drilling environment, in one embodiment we implement a series of surface sonic transmitters disposed along a planned borehole trajectory. FIG. 1 shows how a square (or similar geometry as appropriate to the terrain) grid 11 of transmitters (A, B, C, D) 12 are positioned at the surface and located over the well bore 14 such that their downward reaching sonic wave energy 13 reaches a receiver 15 located in an instrumented sub, which is part of the drilling bottom hole assembly (BHA). It is now apparent that it would be advantageous to preferentially steer each individual sonic wave toward the expected location of the receiver 15 such that the available energy density is maximized at the expected location. This can be achieved by replacing each transmitter A, B, C, and D with two, three or more such transmitters and differentially phasing their waveforms in a manner that causes generally constructive interference of the multiplicity of waves in the preferred direction, and generally destructive interference in unwanted directions. As each node of the grid could contain such a phased array, all the sonic beams could be adaptively steered toward the optimum location of the sonic receiver 15. Furthermore, it is an aspect of our invention that such steering could be spatially 'dithered' in order to sweep the beam conjunction around the estimated location of the downhole receiver. This dithering technique would utilize a time tag or similar encoded data in order that the receiver could detect and decode each such spatially modified set of waves and telemeter the amplitude information back to the surface and thereby enable the phasing control to optimally place the wave energy at the present site of the receiver. The signals that reach the surface may be compared to known real-time GPS position of the transmitters using a processor or other device capable of comparing data.

Figure 2:
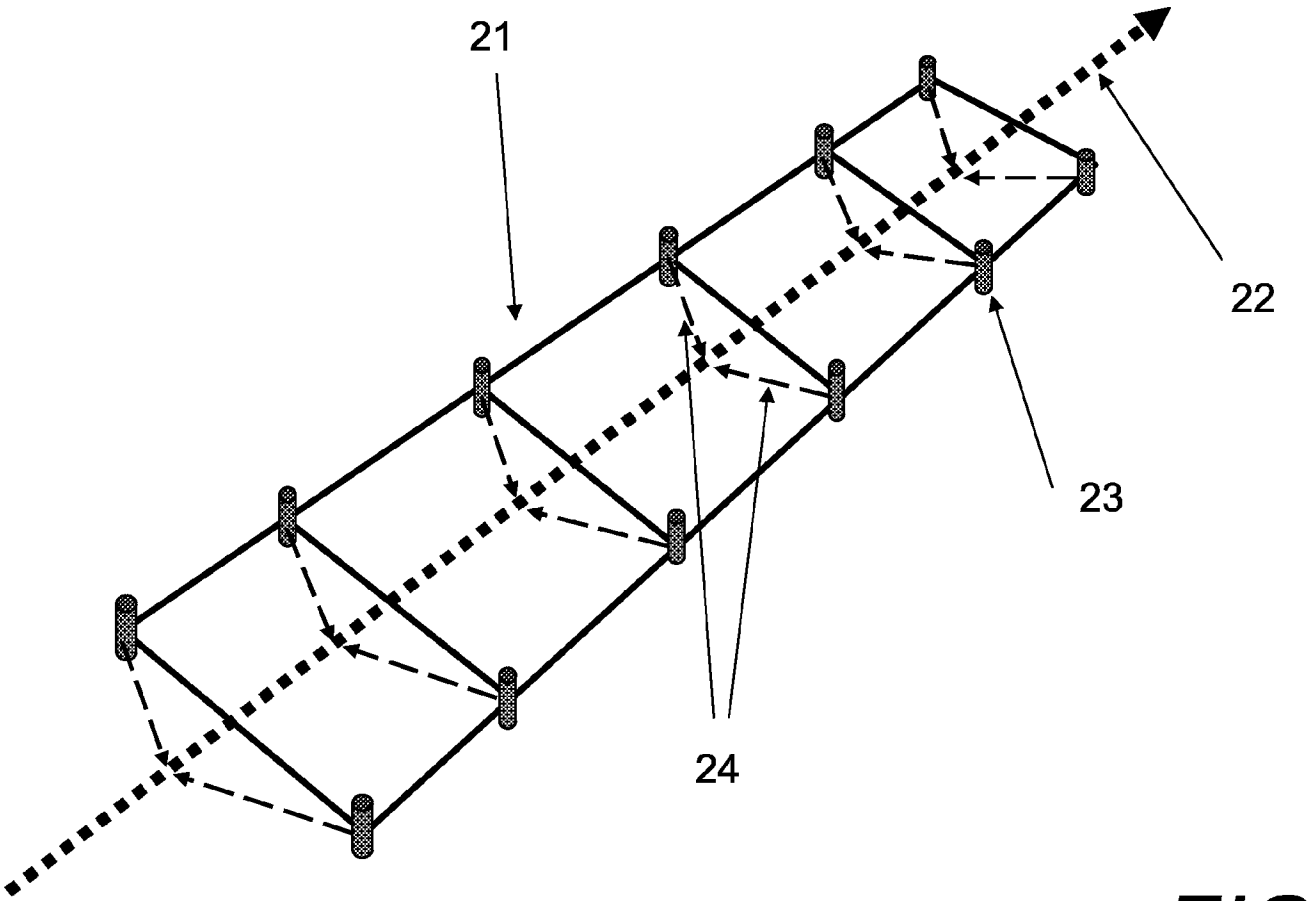
FIG. 2 shows how a pattern of such surface transmitters are deployed such that they are able to send sonic waves toward the path taken by a sonic receiver as it progresses along the well bore.

FIG. 2 extends the grid concept to a series of such grids 21 that are suitably juxtaposed along the well bore 22. At each node 23 the transmitter systems closest to the receiver emit sonic waves 24 in a specific timed pattern, as will be explained later. The position of each surface node (and in one embodiment each of the transmitters associated with a single node) is accurately known by one or more of a number of techniques—for instance GPS or theodolite surveying etc. Such information is critical in triangulating (or ranging) the receiver's position with reference to the series of surface grids. Because our invention ranges the receiver's position as the well proceeds, this position can be further related to some initial reference position proximate to the start of the well. Thus the driller will be enabled to steer the well as planned.

Figure 3:
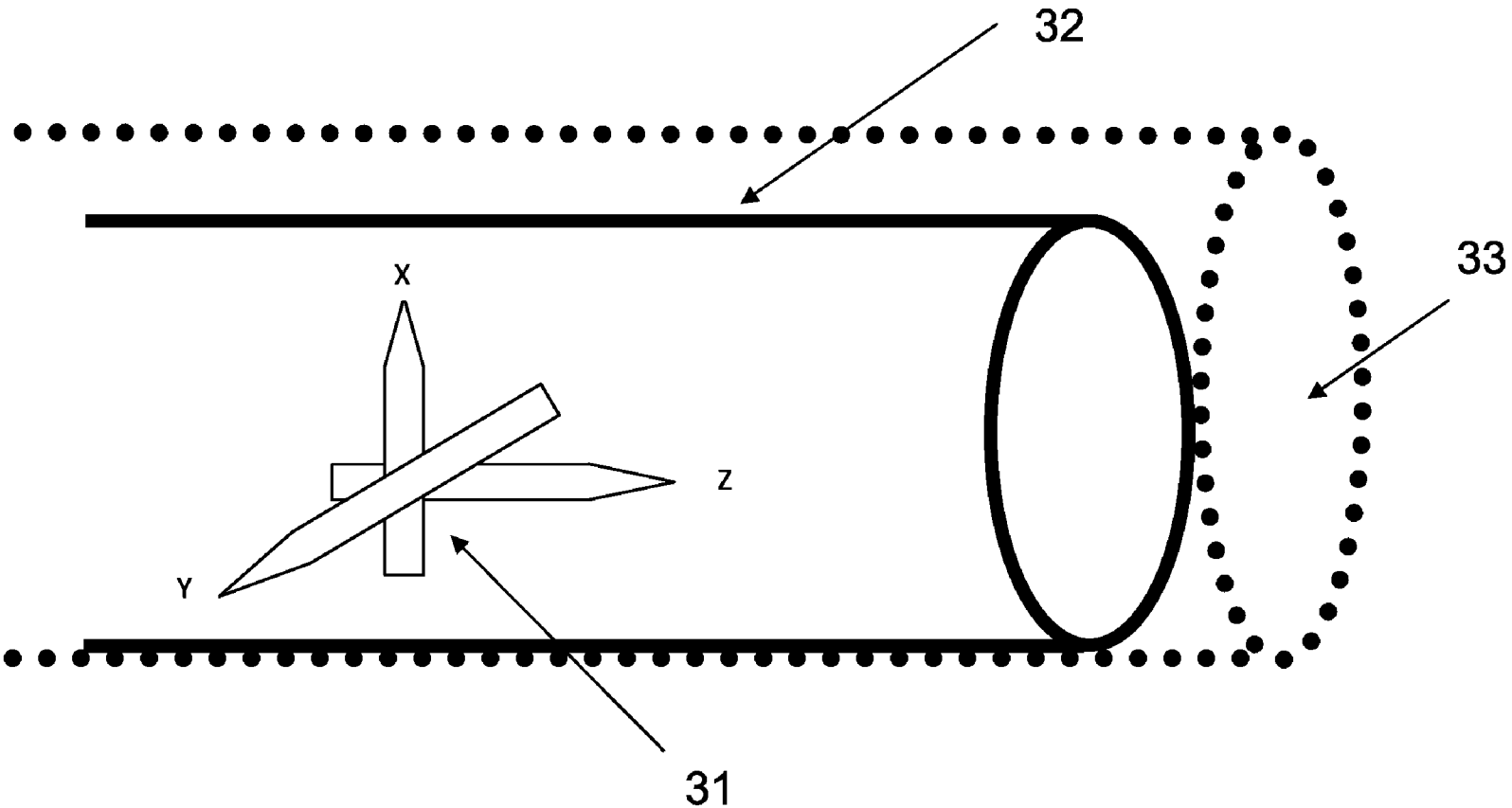
FIG. 3 indicates an orthogonal set of sonic receivers located within an instrumented sub (a part of the drill string), as it travels along the well bore.

The receiver as indicated in FIG. 3 will in general comprise a 3D orthogonal set of sonic receivers (X, Y, Z) 31, each capable of detecting and decoding the sonic energy waveforms. The set of receivers may be comprised of transceivers capable of receiving, encoding, and transmitting data from the BHA to the surface. This 3D receiver, firmly held within the BHA 32 is constrained to travel in the well bore 33, and typically in horizontal wells will preferentially lie along the bottom of the bore. Sonic energy travelling through the formations will activate one of the receivers such that a time of arrival (TOA) for each nearby transmitter node can be determined. This information, with certain other data such as node address, time, signal strength etc. can be encoded and sent back to the drilling rig using convention techniques such as mud pulse telemetry. Once detected and decoded at surface this information can be combined with the known locations of the transmitter nodes and used to estimate time of flight (TOF). TOF information from each node is used to solve a set of simultaneous equations that utilize the speed of sound within the formation and thus determine the distance traveled from node to each successive position of the moving receiver. In general there will be more TOF 'rays' than are necessary to determine position, thus enabling position accuracy enhancement techniques (such as Kalman filters) to be used.

In order to estimate the TOF of a waveform we transmit a signal modulated by a pseudo-noise code with desirable autocorrelation and cross correlation characteristics. The transmission of the signal is synchronized to the system clock such that the start time of the transmission is known. The TOA of the signal is then determined by finding the autocorrelation peak of the received signal and comparing the arrival time with the known start of the transmission.

Figure 4:
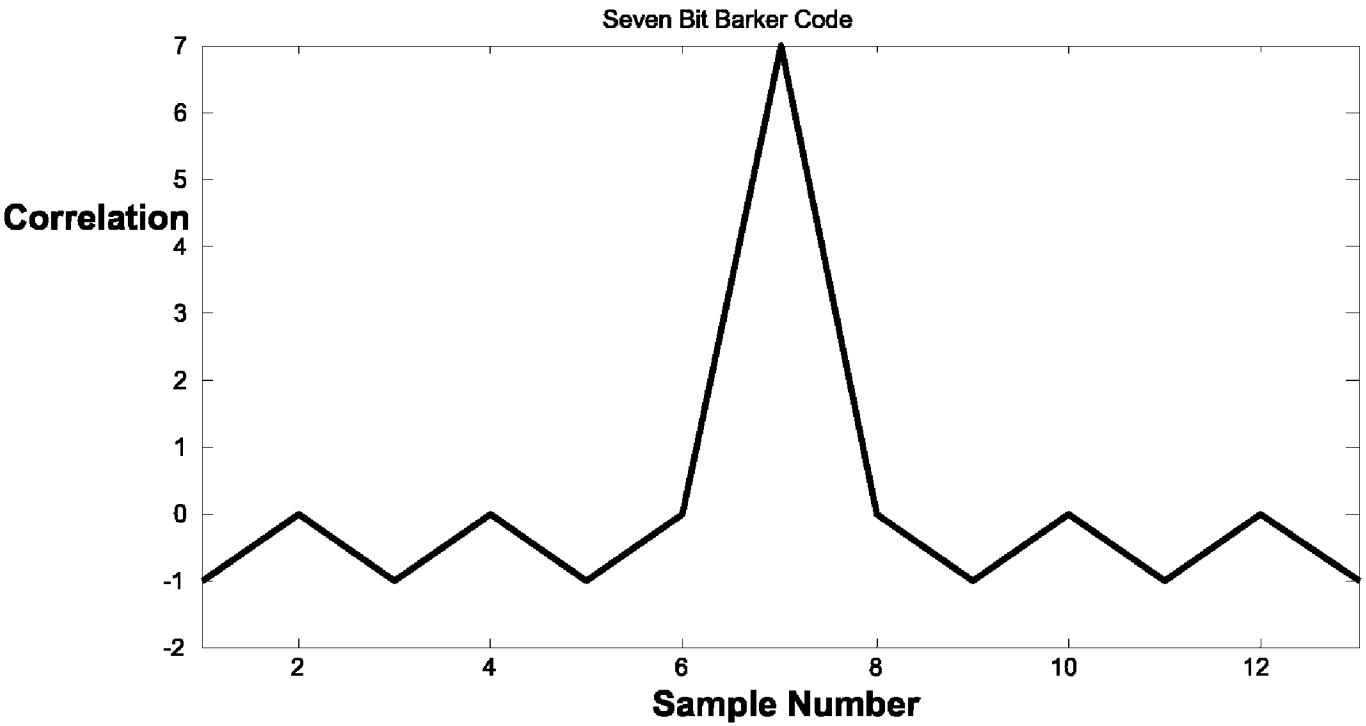
FIG. 4 illustrates a 7-bit Barker code autocorrelation plot.

As an example that is intended to clarify our method, consider the case of a signal modulating a sonic carrier traveling through a lossless medium at a speed of v=2500 m/sec. A 7 bit Barker code (1 1 1 −1 −1 1 −1) may be chosen as the pseudo-noise code due to its attractive autocorrelation characteristics as shown in FIG. 4 whereby the central peak as would be easily detected in the sonic receiver system as it is significantly larger than the outlying peaks. Furthermore the central peak width is only 1 bit wide, leading to a straightforward determination of estimating the TOF.

Figure 5:
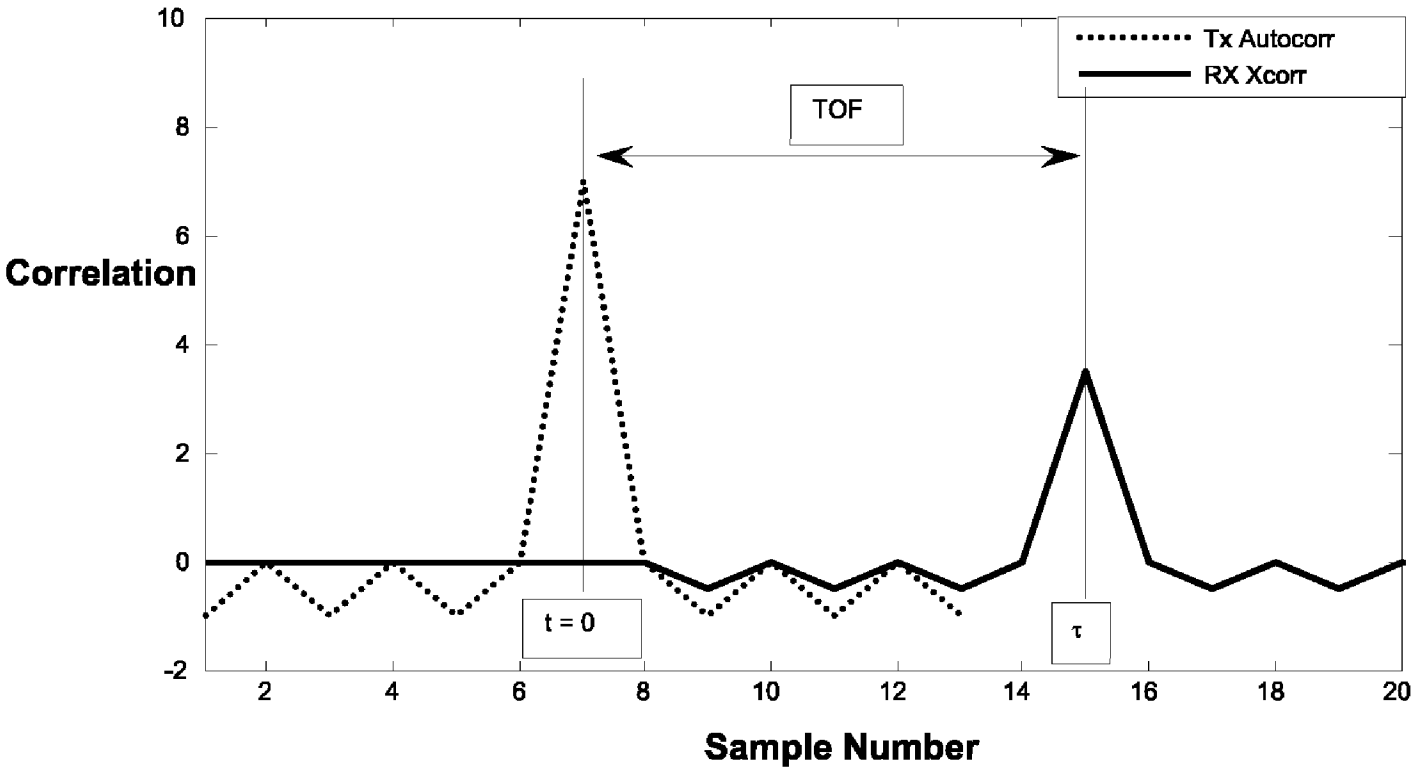
FIG. 5 indicates two waveforms whose correlation enables the time of flight to be estimated.

All seven bits of the code are transmitted at t=0. At t=Δ the signal is arrives at the receiver and is correlated with the receiver's reference waveform. The time of arrival is determined by the time positions of the maximum of the cross-correlation between the reference and received waveforms. Assuming that the receiver has been adequately synchronized with the transmitter the TOF can be calculated using the known sound velocity in the medium, as shown in FIG. 5.

The time domain resolution of the calculation of the time of flight, and hence the spatial resolution, is determined by the bit rate of the code. If a spatial accuracy of 1 meter is required for the example, then the correlation peak must be determined within a single bit period of a maximum duration of 400 μsec. This requires a minimum bit rate of 2500 bits per second. Since the sonic carrier for the system is at 2500 Hz, the system may be considered broadband with impacts on the receiver noise bandwidth and SNR.

Figure 6:
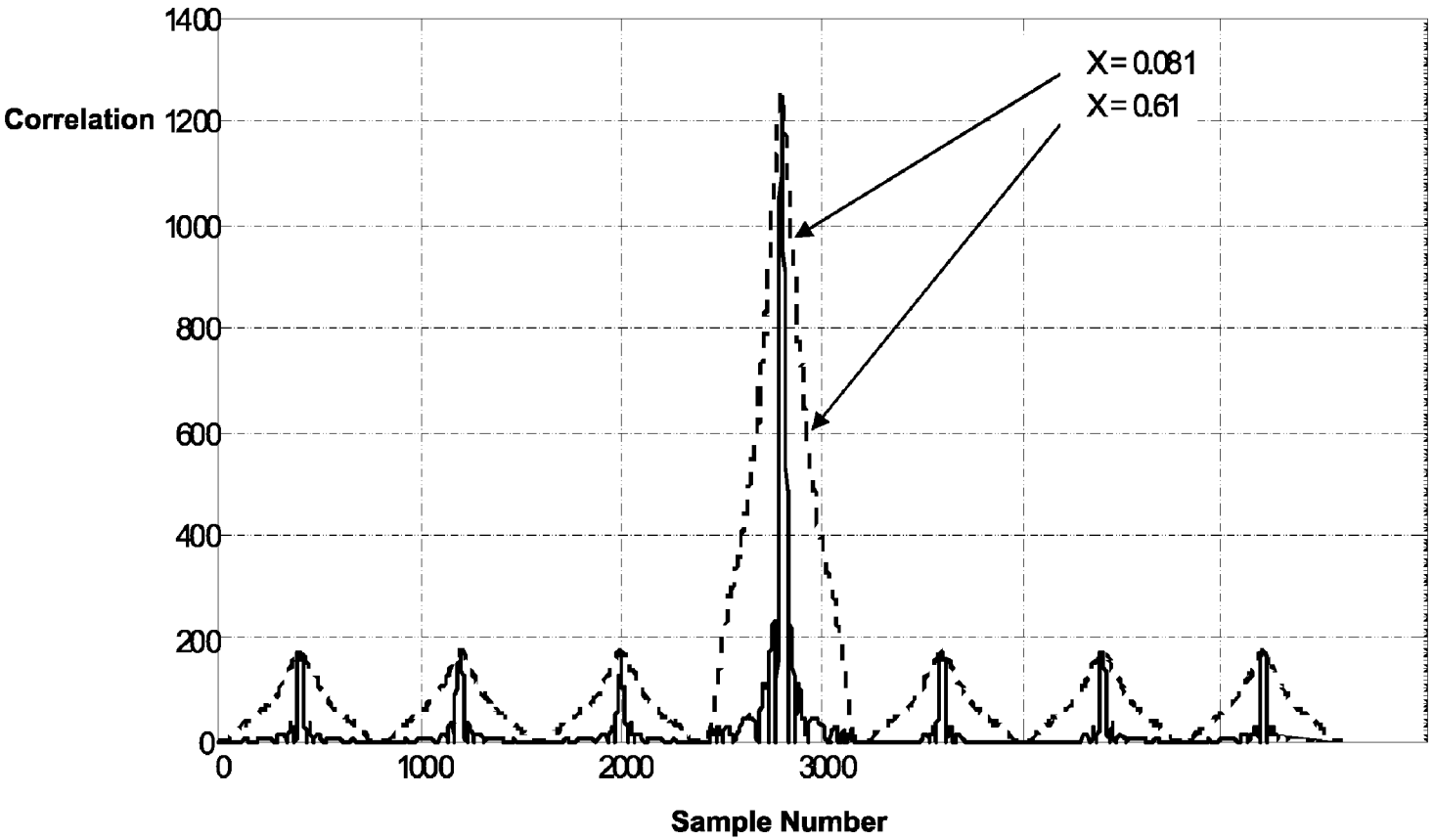
FIG. 6 shows how differing time-bandwidth parameters can provide more accurate ranging resolution from time of flight estimations.

A more desirable solution is one which maintains the spatial resolution but with a narrower receiver bandwidth requirement. One implementation that accomplishes this is to modulate the pseudo-random code onto a series of sonic packets, such as linear chirps (i.e. a substantially sinusoidal waveform that sweeps linearly from one frequency to another) or a simpler frequency modulated sweep, such that these energy packets are transmitted at a much lower rate than the minimum bit rate. The received waveform is sampled at a high enough rate to ensure that the spatial resolution is achieved. For exemplary purposes, consider the advantage of using chirps because the shape of the autocorrelation waveform can be easily modified by increasing the time/frequency product of the component chirps. For example, the time frequency product X for a linear chirp can be defined as:

$$X=aT^2$$

where 'a' is the frequency range of the linear chirp and T is the duration of the chirp. A typical low frequency sonic chirp (less than 1000 Hz average frequency) would, with suitable parameters as could be assumed by those skilled in the art may produce a time/frequency product of less than 0.1. Simply by increasing the frequency span of the linear chirps by a factor of five results in an improved time/frequency product of greater than 0.6. A comparison of the resulting autocorrelation waveforms at Fs=8000 samples per second is in given in FIG. 6.

Figure 7:
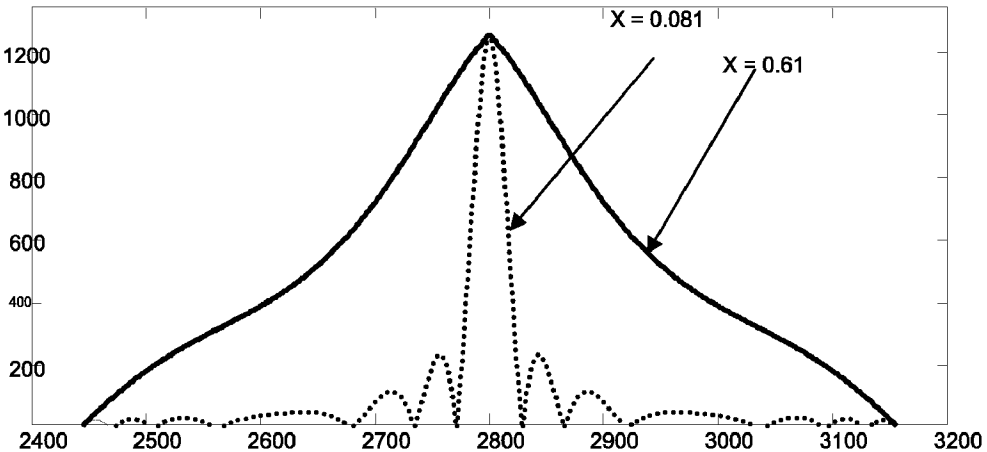
FIG. 7 is an expansion of FIG. 6, showing the main lobe in more detail.

Examination of FIG. 7 shows that the higher time/frequency product results in an autocorrelation waveform with improved (i.e. narrower) resolution, and hence an improved TOF and ranging estimate. This method of simple ranging can be easily extended to a more precise location by increasing the number of sources, each with its own pseudo-random code.

Turning now to the mechanical systems and methods by which sonic energy may be transmitted into the subsurface formations, we cover some of the exemplary embodiments that enable accurate wellbore placement and control within the scope of our invention.

Figure 8:
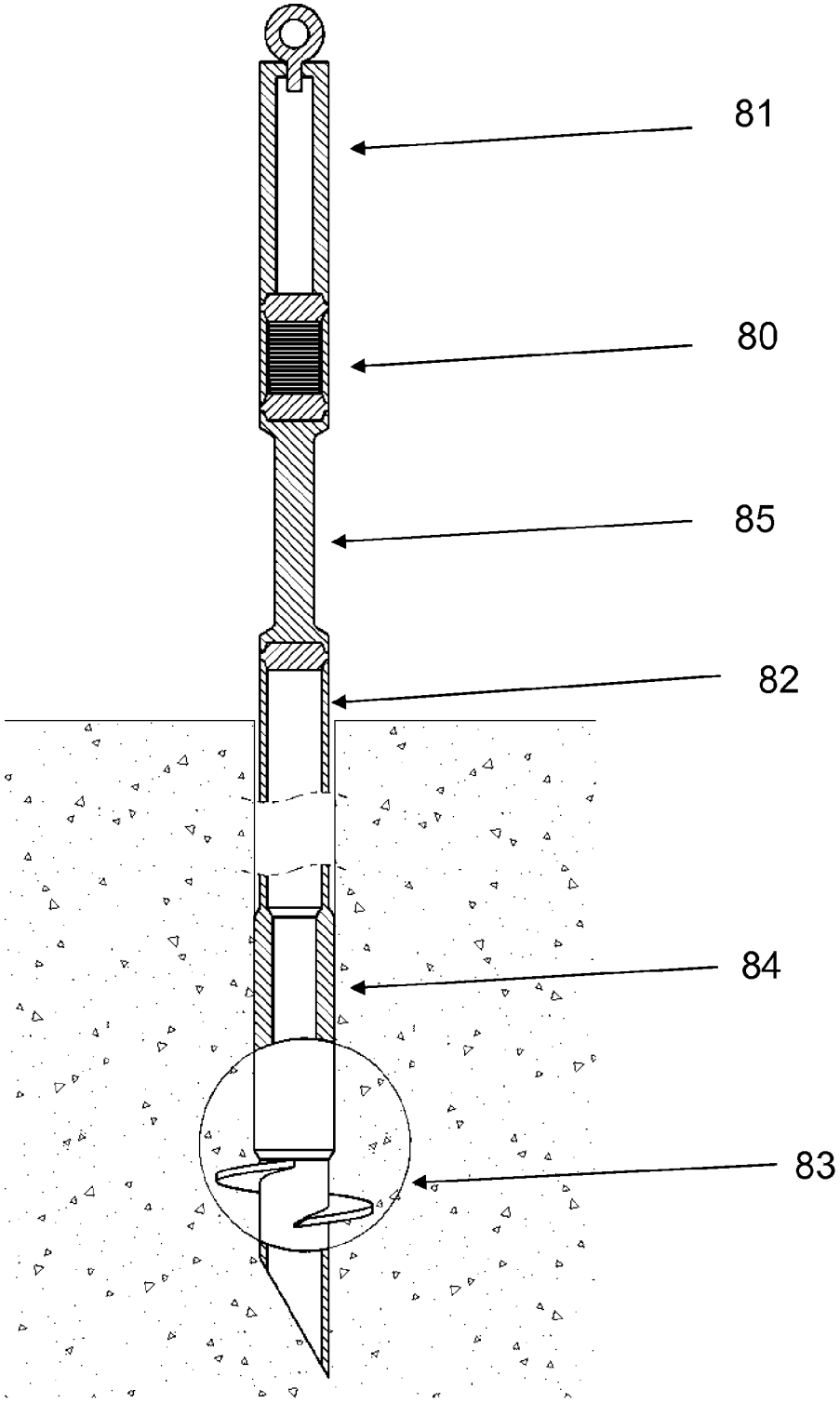
FIG. 8 demonstrates one embodiment of a sonic transmitter capable of transmitting into the earth from a surface position via a screw pile.

FIG. 8 is a sonic transmitter capable of imparting the modulated sonic carrier signal into the earth formations and is an exemplary embodiment thereof. The transmitter consists of four sections that each performs a separate function. The sonic signal is produced by applying an electric potential to the sonic transducer 80. The piezoelectric nature of lead zirconate titanate (PZT) discs produces an axial strain in direct proportion to the potential applied. Stacking the discs in an alternating polarity fashion and placing electrodes between the discs is a well-known process used to amplify the strain produced. The resulting strain causes extensional waves to be emitted from both ends of the transducer and travel in both directions along the centre axis.

The amplitude of the sonic output generated by this transducer can be determined from the axial force, the applied potential and the strain as follows:

$$F=\left(E_C A_C+\frac{L}{\frac{l_P}{A_P E_P}+\frac{l_T}{A_T E_T}}\right)\varepsilon+\frac{N d_{33}\phi}{\frac{l_P}{A_P E_P}+\frac{l_T}{A_T E_T}}$$

where the parameters have their conventional meanings. Extensional waves produced by the source travel at a bar wave speed $C_b$ of:

$$C_b=\sqrt{\frac{E}{\rho}}$$

where E=Young's modulus, ρ=density and has a particle velocity v equal to:

$$v=\frac{F}{Z}$$

where F=force, Z=impedance

The extensional wave travelling up and away from the earth formation enters the reflector section 81 and travels as a bar wave. The wave is reflected by the free end of the reflector, reverses direction and combines with the downward travelling wave emitting from the PZT transducer. The separation distance between the transducer and the free end controls the phase relationship of the wave superposition, and is chosen such that the waves superimpose constructively, effectively doubling the amplitude. Such transducer/reflectors topographies are known to the art of ultrasonic transducers for non-destructive testing, medical and other applications.

The sonic energy is conveyed to the earth formations through a screw pile 82 adapted for sonic use. Screw piles are well known to the art of structural foundation design, as a means to quickly and economically insert piles into soft ground for the purpose of supporting the enormous weight of buildings constructed thereupon. Their ability to be driven to great depths and their large axial load capacity make them an ideal sonic transmitter earth interface. The screw pile is driven down into the desired earth formation by twisting the tube via surface equipment causing the screw portion 83 to pull the pile downward. Extensional waves travelling downward along the pile are converted into pressure waves (P-waves) in the earth formations by the axially exposed surface area of the screw portion and the end of the tube. This mode conversion causes an increase in the impedance encountered by the extensional waves. The combined bar wave and P-wave impedance at this interface is determined as follows:

$$Z_{INTERFACE}=\rho_{BAR}C_{BAR}A_{BAR}+\rho_{EARTH}C_{EARTH}A_{BEARING}$$

where

ρ=density of the appropriate medium,

C=wave velocity in the appropriate medium,

=area through which the wave energy travels

Taking the soil density in the Athabasca oilsands deposits of 2080 kg/m^3 as exemplary, the oilsand P-wave velocities are in the order of 2500 msec. This now enables the impedance of the soil transducer interface to be easily determined.

Considering that the sonic impedance at the interface is greater than that of the tube section of the pile, without a critical modification much of the sonic energy would be reflected back upwards and not transmitted into the earth material. This inventive modification is the inclusion of an impedance matching transformer 84 immediately above the screw section 83 of the pile. With such a feature included the sonic energy is transmitted from one medium to the other without reflection. In this preferred embodiment an impedance match between the tube impedance and interface impedance is accomplished via a quarter wave transformer, fashioned as a section one-quarter wavelength in length with a sonic impedance determined as follows:

$$Z_{QW_TRANSFORMER}=\sqrt{Z_{TUBE}Z_{INTERFACE}}$$

Invariably the sonic impedance of the tube section of the screw pile 82 differs from that of the PZT transducer 80. To prevent a deleterious reflection between these sections an impedance matching transformer 85 is placed in between said transducer and said screw pile.

Assuming a lossless system, the particle velocity at the soil interface can be easily determined by equating the sonic energy produced at the source to the sonic energy at the interface:

$$E=Z_{bar}v_{bar}^2=Z_{soil}v_{soil}^2$$

Alternatively, the sonic efficiency of this transmitter can be determined by calculating the transmitted energy at each impedance change from the PZT to the soil interface, and the true particle velocity at the interface can be determined using the above relationship.

Once transmitted into the earth formations, the signal will propagate as P-waves emanating from a point source. Therefore the signal will geometrically attenuate according to a $1/R^2$ relationship. In addition the signal will attenuate due to internal friction within the earth materials producing small amounts of heat. The extent of material attenuation can be determined with suitably designed field measurements.

Figure 9:
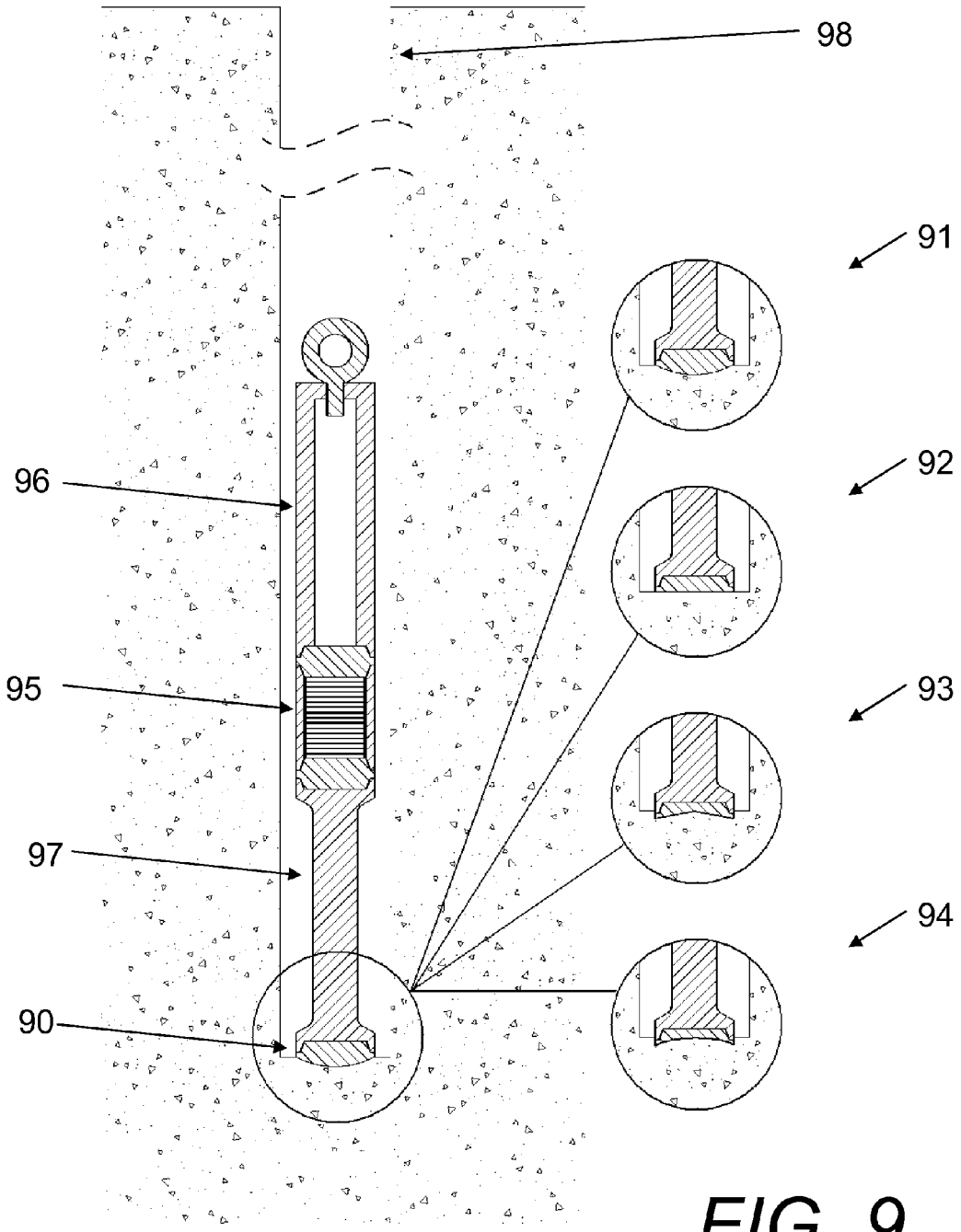
FIG. 9 illustrates another embodiment wherein the screw pile of FIG. 8 is replaced by a simple end plate.

Another embodiment of the invention involves replacing the sonic screw pile altogether with a simple end plate FIG. 9. The end plate 90 can have any practical shape at the face including rounded 91, flat 92, conical 93, concave 94, or specifically, a lens shaped to preferentially steer the direction of the sonic energy emitted (not shown). As before, such a design would have an extensional wave PZT transducer 95 fitted with a reflector 96 above and a sonic transformer 101 below the transducer 95, matching the transducer impedance to that of the earth interface impedance 97. Such embodiments have the additional benefit of having a shape suitable for being lowered into a pre-existing vertically drilled well bore 98. In this way the sonic transmitter may be placed below problematic earth formations and closer to the sonic receiver located in the well bore to be measured, with tremendous benefits to the signal-to-noise ratio (SNR).

The embodiment of FIG. 9 may also be placed on the surface, held vertically in place on a temporary structure or placed in a very shallow auger drilled well bore, thereby eliminating the need and cost associated with a conventionally drilled vertical well bore.

Figure 10:
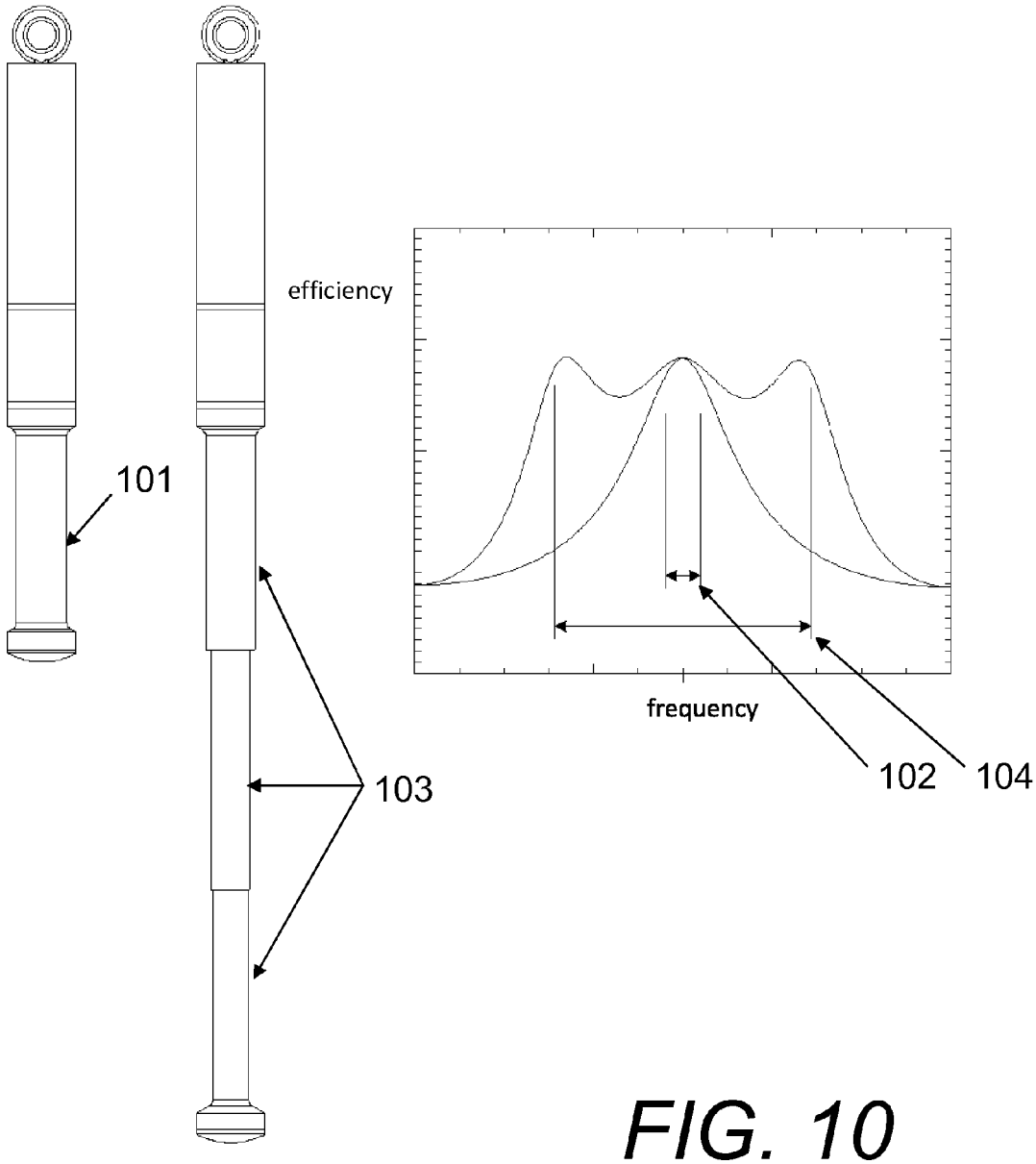
FIG. 10 demonstrates how the sonic efficiency varies with frequency.

The sonic transformers 101 presented above provide an effective impedance match for a specific frequency. FIG. 10 contains a plot of the sonic efficiency versus operating frequency. The plot illustrates that operating a single sonic transformer 101 outside a very narrow frequency band 102 results in a loss of efficiency. As an alternative embodiment, replacing these sonic transformers 101 with a plurality of transformers 103 with impedances matched to the material on either side extends the efficient operating bandwidth 104 of the device, therefore producing a broadband sonic impedance match.

Figure 11:
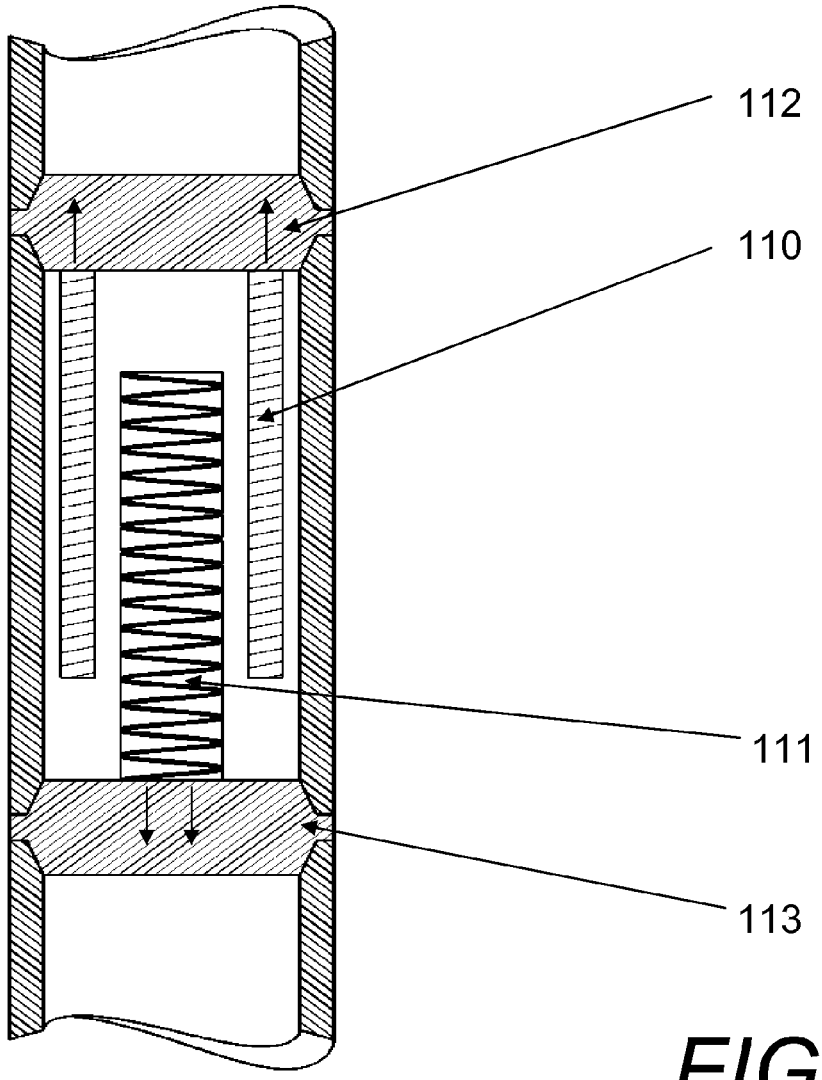
FIG. 11 illustrates how the PZT transducer may be replaced using an electromagnetic force transducer.

As an alternative embodiment to the PZT sandwich transducer, extensional sonic waves may be generated using an electromagnetic axial force transducer, as depicted in FIG. 11. In this embodiment, electric current applied to a pair of concentric electromagnetic coils 110, 111 produces concentrated magnetic fields that are strongly opposed to one another. As a result, each coil tends to push (or pull) on the adjoining ends of the transducer 112, 113. This axial force causes the emission of extensional sonic waves in direct proportion to the applied electric current.

Figure 12:
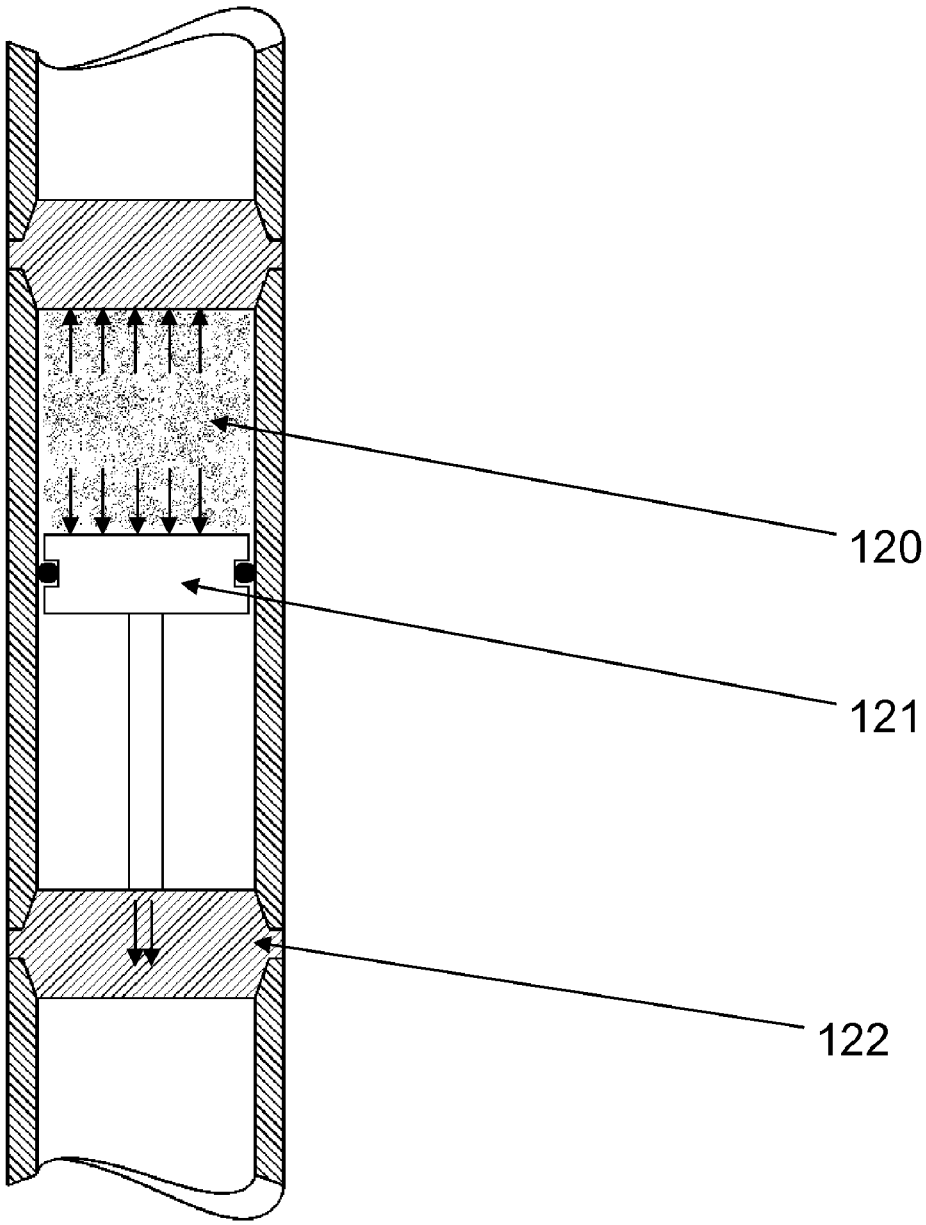
FIG. 12 illustrates how the PZT transducer may be replaced using a hydraulic axial force transducer.

Another alternative embodiment to the PZT sandwich transducer involves the implementation of a hydraulic axial force transducer FIG. 12. In this embodiment an incompressible fluid 120 applies pressure to a typical hydraulic piston-cylinder arrangement. The pressure applied to the piston 121 causes an axial force to be applied to one end of the transducer 122. This axial force causes the emission of extensional sonic waves in direct proportion to the applied fluid pressure. Such hydraulic arrangements are well suited to generating the large axial forces needed for high-powered sonic transmissions.

In an alternative embodiment the location of the sonic transmitter and receiver is reversed. Using FIG. 1 with equipment rearranged, a sonic transmitter 12 would be located in the well bore 14 and sonic receivers 15 would be located at several points on the surface in a grid arrangement 11. In this embodiment, the surface receivers would comprise commercially available accelerometers, geophones, or geophone arrays. Alternative variations in the sonic source give rise to several embodiments therein.

Figure 13:
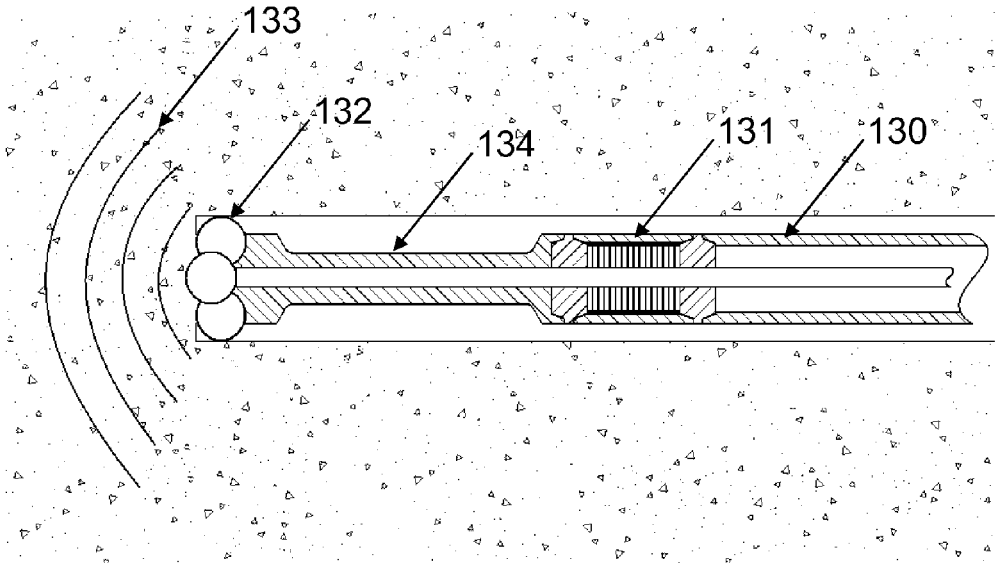
FIG. 13 shows an alternative embodiment that causes sonic energy to be initially sent axially into the formation by a PZT transducer located in the BHA near to the drill bit.

One such embodiment, shown in FIG. 13, involves the production of extensional sonic waves in the BHA 130 using a PZT sandwich transducer 131 placed preferentially near the drill bit 132. These extensional waves travel through the drill bit 132 and are emitted into the formation where they propagate as P-waves 133 emanating from a point source. In this arrangement, an impedance matching transformer 134 is placed between the drill bit and the PZT source such that sonic waves generated are transmitted efficiently into the earth formations. It is now obvious that the surface receiver could easily by implemented by periodic arrays of geophones, as is conventional in seismic surveying. A technical issue is that for optimum detection the data from the surface sonic receivers would be ideally be brought to a common data processing point that also had a time-based data that contained information on when some or all of the downhole sonic waves were transmitted. This would form the basis of a synchronous system that, as is well known in the art, has detection and decoding advantages over non-synchronous systems. One implementation of such a synchronous system would be to cause the PZT sandwich transducer 131 transmit under timed signals from a wired link, as would be available with a coiled tubing downhole drilling system for example. The surface equipment could obtain its timing information from a timing source, such as an accurate clock, or a GPS time signal, as are readily available today. The same signal would be made available to the surface detection and data processing device, thereby achieving synchronicity advantages as discussed.

Figure 14:
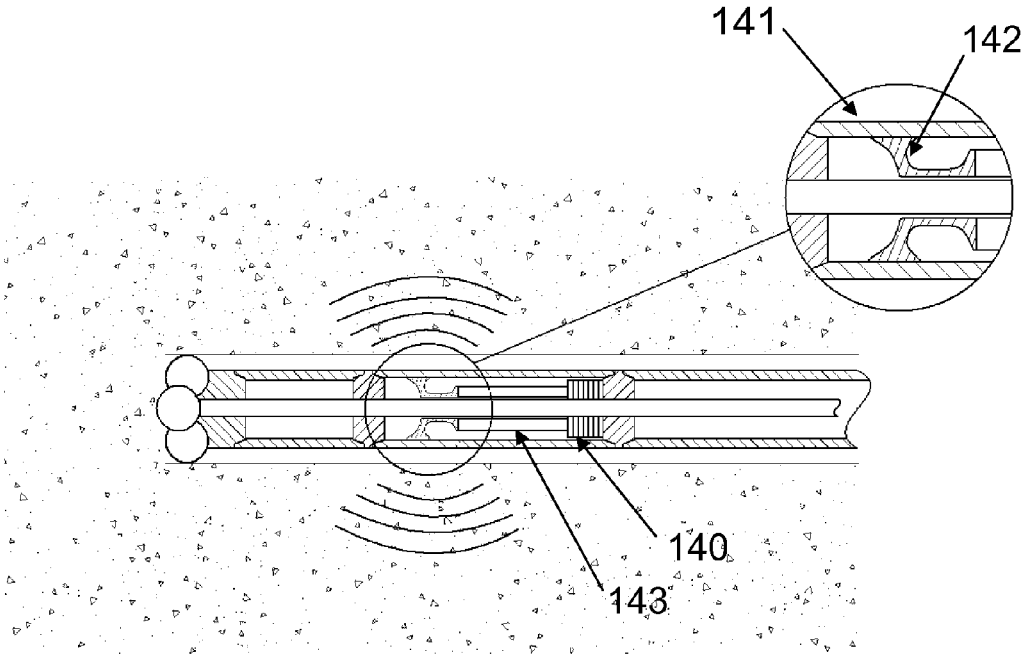
FIG. 14 illustrates another embodiment that sends sonic energy radially into the formation.

Yet another embodiment emits the sonic energy in a radial direction from the well bore FIG. 14, thereby circumventing the likely suboptimal sonic properties of the drill bit interface. In this embodiment, the extensional waves generated by the source transducer 140 are converted into radial deflections of the tool casing 141 by means of a specifically designed mode conversion component 142. The component is shaped such that axial deformation induced by the source transducer is elastically transmitted into radial deformation in the tool casing. The impedance of such an arrangement may be determined by elastic structural techniques such as finite element analysis (FEA). The extensional source and radial emitting impedances would be matched by including a sonic impedance matching transformer 143. To convey this radial deformation efficiently into the earth formations, such a device would be fitted with a device adapted to push against the well bore (not shown).

Figure 15A:
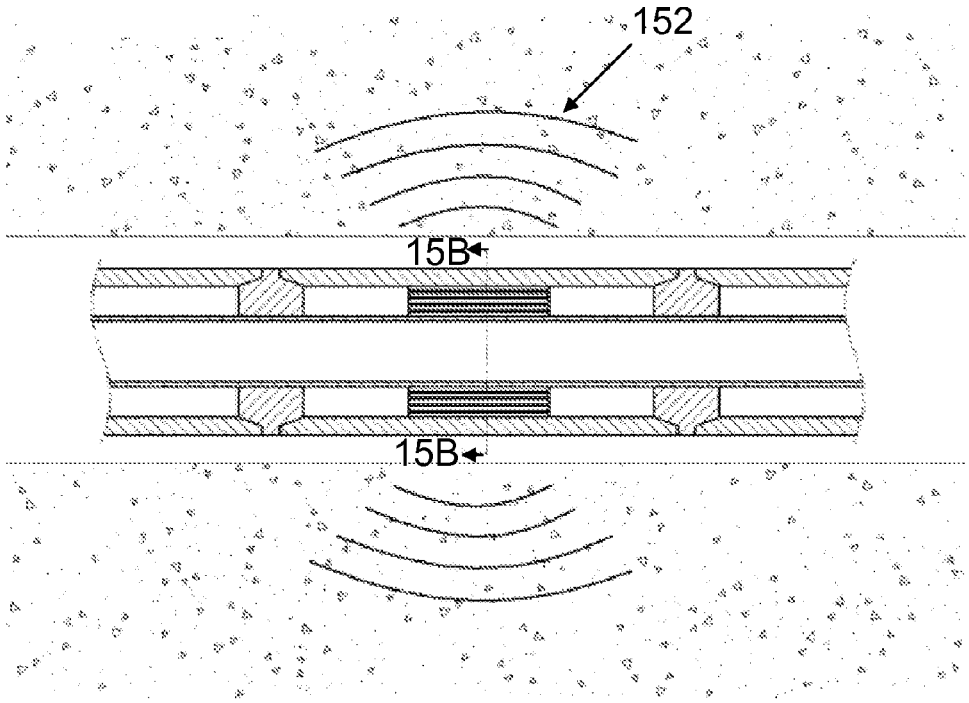
FIG. 15A shows yet another embodiment that emits sonic energy in a radial direction involves the implementation of a radially deforming PZT sandwich transducer.
Figure 15B:
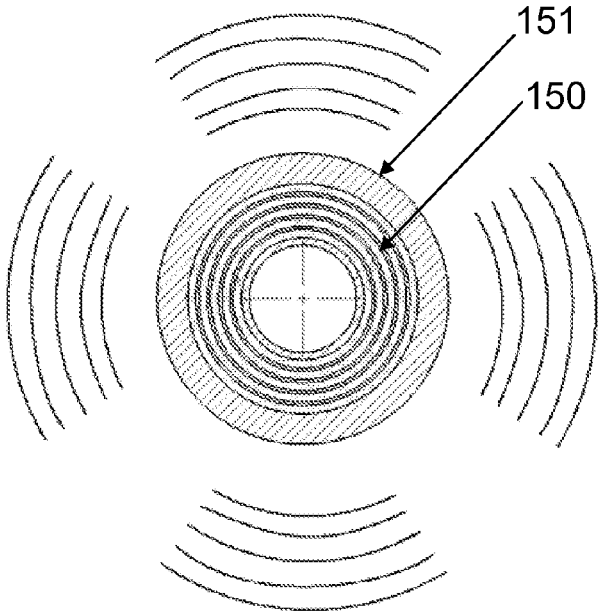
FIG. 15B is a cross sectional view of the embodiment shown in FIG. 15A taken along the cut line.

Another embodiment that emits sonic energy in a radial direction involves the implementation of a radially deforming PZT sandwich transducer as shown in FIGS. 15A-B. In this embodiment, the PZT material is fashioned into concentric cylinders, or partial cylinders, with electrodes 150 therebetween. In response to an applied electric potential, the PZT material will exhibit radial strain. When this transducer is well coupled to the external housing of the device 151, the radial strain will cause radial deformation of the housing thereby emitting sonic pressure waves 152. To convey this radial deformation efficiently into the earth formations, such a device would be fitted with a device adapted to push against the well bore (not shown).

Another embodiment that emits sonic energy in a radial direction is shown in FIGS. 16A-C and involves the implementation of a conventional stacked disc PZT sandwich transducer 160 oriented in such a way that the axial force 161 generated pushes directly onto the tool casing 162. To minimise the tendency of the casing to deform out-of-round, two or more PZT transducers would be arranged orthogonally; herein shown as an orthogonally arranged pair of transducers 163. With such an arrangement, sonic P-waves 164 would be emitted radially from the casing in direct proportion to the electric potential applied to the transducers. To convey this radial deformation efficiently into the earth formations, such a device would be fitted with a standard device, as is known in the industry, adapted to push against the well bore (not shown).

It is to be understood that while certain aspects of the disclosed subject matter have been shown and described, the disclosed subject matter is not limited thereto and encompasses various other embodiments and aspects. The above-mentioned steps and components are not meant to limit the use or organization of the present invention. The steps for performing the method may be performed in any logical method and the process can be used for other types of image-matching processes when viable.

Having thus described the invention, what is claimed as new and desired to be secured by Letters Patent is:

1. A sonic telemetry system for determining the positional profile of a subsurface well including a bottom hole assembly (BHA) and formed with a drill including a drill bit, which system comprises:

multiple surface sonic transmitters positioned along an intended path of a well located within a known soil formation;

a sonic downhole transceiver positioned in proximity to the BHA, said sonic downhole transceiver being adapted for receiving signals from the surface sonic transmitters and transmitting a telemetered data stream from the drill;

a surface receiving device adapted for receiving said telemetered data stream;

said telemetered data stream comprising relative time of flight (TOF) information retrieved from signals sent by said surface transmitters and received by said sonic downhole transceiver;

a processor connected to said surface receiving device and programmed to compare said TOF information with actual transmission times and the surface locations of the transmitting transmitters;

said processor being adapted for calculating the position of the sonic downhole transceiver relative to said sonic transmitters during a drilling operation based on the TOF and the time of transmission data collection;

wherein said processor for comparing TOF is adapted to include correlation properties of a pseudo noise code directly modulated on the sonic carrier using standard digital modulation methods to determine the TOF at a resolution sufficient to achieve a one meter or better ranging accuracy;

said pseudo noise code bits are modulated onto linear frequency chirps then transmitted at a rate below the directly modulated code;

said linear frequency chirps used to improve correlation properties of the pseudo noise code, whereby said correlation property improvements result in a reduced receiver bandwidth with equal ranging accuracy; and said surface sonic transmitters further comprise an extensional wave sonic source and an interface at which extensional bar waves are converted to pressure waves (P-waves) in the subsurface formation.

2. The system of claim 1, wherein:

said extensional wave sonic source is adapted to produce an impedance change at such a distance from the source that a beneficial reflection is obtained; and said beneficial reflection combines constructively with the wave generated by said transducer, but traveling in the opposite direction.

3. The system of claim 2, further comprising:

a soil interface comprising a modified screw pile having a smooth tube and spiral threads; and wherein said extensional bar waves are converted to pressure waves due to the interlock of the spiral threads of said modified screw pile with said soil formation.

4. The system of claim 3, wherein:

said screw pile is fitted with a sonic impedance matching transformer between said smooth tube and spiral thread form sections.

5. The system of claim 1, wherein:

said extensional wave sonic source is a piezoelectric sandwich transducer; and there is contraction of the piezoelectric material in response to an applied electrical potential.

6. The system of claim 1, wherein:

said extensional bar wave source is an electromagnetic transducer which generates an axial force in proportion to hydraulic fluid pressure applied to a piston cylinder arrangement.

7. The system of claim 1, wherein:

a soil interface is comprising an indenter mechanically connected to the distal end of a bar such that the extensional bar waves traveling in the bar are converted into radially travelling pressure waves in the subsurface formations.

8. The indenter according to claim 7, wherein said indenter is formed in a geometric shape selected from a sphere, a cone, a concave cylinder, a flat-faced cylinder, and a lens-shaped cylinder to focus the shape of the interface surface for optimal sound wave transference.

9. The system of claim 1, including:

a vibrator placed at the surface of said soil formation, said vibrator adapted to produce a source impedance in said soil formation;

a transformer placed between said soil formation and the vibrator, said transformer adapted to match said source impedance.

10. The system of claim 9, including:

a plurality of sonic transformers placed in series with said source impedance suitably determined to produce an overall impedance match over a range of operating frequencies greater than the range available from a single impedance matching design.

11. The system of claim 1, further comprising:

said sonic downhole transceiver adapted to encode the signal prior to transmitting said signal to the surface; and the surface processor programmed to decode said encoded signal.

12. A sonic telemetry system for determining the positional profile of a subsurface well including a bottom hole assembly (BHA) and formed with a drill including a drill bit, which system comprises:

multiple sonic transmitters positioned along an intended path of a well;

a sonic downhole transceiver positioned in proximity to the BHA, said downhole transceiver being adapted for receiving signals from the surface sonic transmitters and transmitting a telemetered data stream from the drill;

a surface receiving device adapted for receiving said telemetered data stream;

said telemetered data stream comprising relative time of flight (TOF) information retrieved from signals sent by said surface transmitters and received by said downhole transceiver;

a processor connected to said surface receiving device and programmed to compare said TOF information with actual transmission times and the surface locations of the transmitting transmitters;

said processor being adapted for calculating the position of the downhole transceiver relative to said sonic transmitters during a drilling operation based on the TOF and the time of transmission data collection;

said processor programmed for comparing TOF includes correlation properties of a pseudo noise code directly modulated on the sonic carrier using standard digital modulation methods to determine the TOF at a resolution sufficient to achieve a one meter or better ranging accuracy;

said pseudo noise code bits are modulated onto linear frequency chirps then transmitted at a rate below the directly modulated code;

said linear frequency chirps used to improve correlation properties of the pseudo noise code, whereby said correlation property improvements result in a reduced receiver bandwidth with equal ranging accuracy;

said sonic transmitters further comprise an further comprised of an extensional wave sonic source and an interface at which extensional bar waves are converted to pressure waves (P-waves) in the subsurface formation; and the varying position of the downhole transceiver is calculated as drilling proceeds based on the TOF and time of transmission data collected.

13. The system of claim 12, wherein:

said extensional wave sonic source adapted to produce an impedance change at such a distance from the source that a beneficial reflection is obtained; and said beneficial reflection combines constructively with the wave generated by said transducer, but traveling in the opposite direction.

14. The system of claim 13, further comprising:

a soil interface comprising a modified screw pile having a smooth tube and spiral threads; and wherein said extensional bar waves are converted to pressure waves in the subsurface formation due to the interlock of the spiral threads of said modified screw pile with said soil formation.

15. The system of claim 14, wherein:

said screw pile is fitted with a sonic impedance matching transformer between said smooth tube and spiral thread form sections.

16. The system of claim 12, wherein:

said extensional wave sonic source is a piezoelectric sandwich transducer; and there is contraction of the piezoelectric material in response to an applied electrical potential.

17. A method of drilling a well using a drill containing a bottom hole assembly (BHA) and a drill bit, comprising the steps:

placing multiple surface sonic transmitters along an intended path of a well located within a known soil formation;

positioning a sonic downhole transceiver in proximity to the BHA, said sonic downhole transceiver being adapted for receiving signals from the surface sonic transmitters and transmitting a telemetered data stream from the drill;

providing a surface receiving device adapted for receiving said telemetered data stream, wherein said telemetered data stream comprises relative time of flight (TOF) information retrieved from signals sent by said surface transmitters and received by said sonic downhole transceiver;

connecting a processor to said surface receiving device;

programming said processor to compare said TOF information with actual transmission times and the surface locations of the transmitting transmitters;

calculating the position of the sonic downhole transceiver relative to said sonic transmitters during a drilling operation based on the TOF and the time of transmission data collection with said processor;

configuring said processor for comparing TOF to include correlation properties of a pseudo noise code directly modulated on the sonic carrier using standard digital modulation methods to determine the TOF at a resolution sufficient to achieve a one meter or better ranging accuracy;

modulating said pseudo noise code bits onto linear frequency chirps;

transmitting said pseudo noise code bits at a rate below the directly modulated code;

improving correlation properties of the pseudo noise code using said linear frequency chirps, whereby said correlation property improvements result in a reduced receiver bandwidth with equal ranging accuracy;

providing said sonic surface sonic tranmitters with an extensional wave sonic source and an interface; and converting extensional bar waves to pressure waves (P-waves) in the subsurface formation.

18. The method of claim 17, further comprising the additional steps:

producing an impedance change with said extensional wave sonic source at such a distance from the source that a beneficial reflection is obtained; and wherein said beneficial reflection is combined constructively with the wave generated by said transducer, but traveling in the opposite direction.

19. The method of claim 18, further comprising the additional steps:

providing a soil interface comprising a modified screw pile having a smooth tube and spiral threads; and converting said extensional bar waves to pressure waves due to the interlock of the spiral threads of said modified screw pile with said soil formation.

20. The method of claim 18, further comprising the additional steps:

fitting said screw pile with a sonic impedance matching transformer between said smooth tube and said spiral thread form sections.

21. The method of claim 17, wherein:

said extensional wave sonic source is a piezoelectric sandwich transducer; and there is contraction of the piezoelectric material in response to an applied electrical potential.

22. The method of claim 17, wherein said extensional bar wave source is an electromagnetic transducer which generates an axial force in proportion to hydraulic fluid pressure applied to a piston cylinder arrangement.

23. The method of claim 17, further comprising the additional steps:

providing a soil interface comprising an indenter; and mechanically connecting said indenter to the distal end of a bar such that the extensional bar waves traveling in the bar are converted into radially travelling pressure waves in the subsurface formations.

24. The method of claim 23, wherein said indenter is formed in a geometric shape selected from a sphere, a cone, a concave cylinder, a flat-faced cylinder, and a lens-shaped cylinder to focus the shape of the interface surface for optimal sound wave transference.

25. The method of claim 17, further comprising the additional steps:

placing a vibrator at the surface of said soil formation, said vibrator adapted to produce a source impedance in said soil formation; and placing a transformer between said soil formation and the vibrator, said transformer adapted to match said source impedance.

26. The method of claim 25, further comprising the additional steps:

providing a plurality of sonic transformers placed in series with said source impedance suitably determined to produce an overall impedance match over a range of operating frequencies greater than the range available from a single impedance matching design.

27. The method of claim 17, further comprising the additional steps:

configuring said sonic downhole transceiver to encode the signal prior to transmitting said signal to the surface; and programming said surface processor to decode said encoded signal.

* * * * *